US008206248B2

(12) United States Patent
Iizawa et al.

(10) Patent No.: US 8,206,248 B2
(45) Date of Patent: Jun. 26, 2012

(54) RACKET

(75) Inventors: Masatoshi Iizawa, Niigata (JP); Tadashi Saito, Tokyo (JP); Naoto Ogawa, Niigata (JP)

(73) Assignee: Yonex Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/825,754

(22) Filed: Jun. 29, 2010

(65) Prior Publication Data

US 2010/0331126 A1 Dec. 30, 2010

(30) Foreign Application Priority Data

Jun. 30, 2009 (JP) ..... 2009-155789

(51) Int. Cl.
*A63B 49/02* (2006.01)

(52) U.S. Cl. ..... 473/539; 473/522

(58) Field of Classification Search ..... 473/520–522, 473/539–541, 546; D21/729, 730
See application file for complete search history.

(56) References Cited

U.S. PATENT DOCUMENTS

| | | | | | |
|---|---|---|---|---|---|
| 1,523,865 | A * | 1/1925 | Craig | 473/542 |
| 3,567,225 | A * | 3/1971 | Hollis | 473/537 |
| 3,884,467 | A * | 5/1975 | Sommer | 473/539 |
| 4,394,014 | A * | 7/1983 | Balaban | 473/546 |
| 4,697,811 | A * | 10/1987 | Muroi | 473/519 |
| 4,930,782 | A * | 6/1990 | Sines et al. | 473/537 |
| 5,060,944 | A * | 10/1991 | Janes | 473/539 |
| 5,251,895 | A * | 10/1993 | Darling | 473/520 |
| 5,257,781 | A * | 11/1993 | Sines et al. | 473/539 |
| 5,368,297 | A * | 11/1994 | Liu | 473/539 |
| 6,336,877 | B1 * | 1/2002 | Arroyo et al. | 473/539 |
| 6,527,656 | B1 * | 3/2003 | Cheng et al. | 473/540 |
| 7,217,203 | B2 * | 5/2007 | Takeuchi et al. | 473/537 |
| 7,431,673 | B2 * | 10/2008 | Niwa et al. | 473/543 |
| D596,682 | S * | 7/2009 | Severa et al. | D21/730 |
| 7,887,444 | B1 * | 2/2011 | Severa et al. | 473/539 |
| 2006/0172827 | A1 * | 8/2006 | Soekahar | 473/520 |
| 2008/0274843 | A1 * | 11/2008 | Gazzara et al. | 473/536 |
| 2010/0331126 | A1 * | 12/2010 | Iizawa et al. | 473/521 |
| 2011/0039641 | A1 * | 2/2011 | Severa et al. | 473/539 |

FOREIGN PATENT DOCUMENTS

| | | | |
|---|---|---|---|
| JP | 6-269514 | A | 9/1994 |
| JP | 2003225330 | A * | 8/2003 |
| JP | 2004105558 | A * | 4/2004 |
| JP | 2011010746 | A * | 1/2011 |

* cited by examiner

*Primary Examiner* — Raleigh W Chiu
(74) *Attorney, Agent, or Firm* — McDermott Will & Emery LLP

(57) ABSTRACT

A tennis racket includes a frame that includes a shaft and a looped frame portion, the shaft having a grip formed on one end side thereof, the frame portion being joined to the other end side of the shaft and forming a hitting face with a string being strung across and a plurality of insertion holes that provide communication between an inner peripheral side surface and an outer peripheral side surface of the frame portion and through which the string is inserted. Shock absorbing portions and hard portions are provided in an alternating fashion on at least a part of the outer peripheral side surface of the frame portion. Each shock absorbing portion is formed between insertion holes that are adjacent to each other. Each hard portion is formed between insertion holes that are adjacent to each other and is less elastically deformable than the shock absorbing portion.

10 Claims, 14 Drawing Sheets

RACKET

CROSS-REFERENCE TO RELATED APPLICATIONS

The present application claims priority upon Japanese Patent Application No. 2009-155789 filed on Jun. 30, 2009, which is herein incorporated by reference.

BACKGROUND

1. Technical Field

The present invention relates to a tennis racket.

2. Related Art

It is well known that a tennis racket generally includes a frame and a string. The frame has a structure including a looped frame body (hereinafter referred to as a loop portion) that serves as a ball hitting face (hitting face) and a shaft portion provided with a grip at an end thereof. The hitting face is formed by stringing across a string inwardly of the loop portion.

As described in JP-A-6-269514, there are various performances required for the tennis racket and one of the important performances required is a "hitting feel". The hitting feel is a performance related to a feel that is transmitted to an arm or a hand holding the racket upon hitting the ball and can be quantitatively expressed, for example, by an amplitude of vibration of the string, time taken for the amplitude to damp, or a coefficient of restitution when the racket is supported at a grip position in the air with the hitting face horizontal to the ground surface and a ball is dropped from a predetermined height to the hitting face in such a state.

Qualitatively, the hitting feel is often expressed with an expression such as "hard" and "soft". Generally, "hard" represents a feel in which there is a strong impact in hitting the ball but a high ball speed can be obtained and the racket can be quickly swung through, and may also be referred to as a "agile feel/speed feel". On the other hand, with the "soft" feel, even if the ball is hit outside a central region in the hitting face, a so-called sweet spot, which provides an easier repulsion of the ball, the impact is weak. Also, it represents a feel with which a high ball speed cannot be achieved but a ball direction can be positively controlled. This may also be referred to as a "refreshing feel/comfort feel".

Preference between such feels certainly differs between players depending on their age, sex, skill level and physical strength and also differs for the same player depending on his or her training hours and time, season and physical condition. For example, a player may prefer a hard feel at the beginning of the training since he/she has physical strength, whereas he/she may prefer a soft hitting feel as he/she gets exhausted by the training and a power of the arm to receive the shock from the ball is reduced. Further, a string expands and contracts in accordance with temperature and humidity. Further, a repulsion force of the ball changes due to a change in an elasticity of rubber forming the ball in accordance with the temperature. Therefore, even if the same racket is used, the hitting feel may change through the year.

Whether being a professional or an amateur, there is a wide variety of tennis players. There is a wide range of physical strength and skill for individuals between different age and sex and even between those of the same age and sex. Accordingly, there are various the hitting feels preferred by individual players. Recently, there are many players who wish to play with different hitting feels depending on the physical strength or the mood that occasionally change or depending on the season, etc.

In the past, since the hitting feel relied on a tension of a string or a flexibility of the frame itself of the racket, if the player wanted to play with different hitting feels, he/she needed to posses a plurality of rackets with frames of different hitting feels or rackets strung with different tensions, or, depending on the season, to restring by specifying the tension to obtain a preferred hitting feel.

However, for an ordinary amateur tennis player, it is a great economic burden to possess a plurality of rackets. Further, with a training using rackets of different frames in turn, the player cannot get used to the rackets and, particularly, it takes time for a beginner to improve his/her skill. In a case of having it restrung by specifying the tension, it is difficult to obtain a preferred hitting feel unless he/she is an experienced or an advanced-level player since an experience or a professional knowledge on correlation between the tension and the hitting feel is required.

SUMMARY

The invention has been made in view of such drawbacks and its object is to provide a racket with which different hitting feels can be easily obtained and which can be offered to a use without a great financial burden.

In order to achieve the object described above, the main aspect of the invention is a tennis racket including:

a frame that includes a shaft and a looped frame portion, the shaft having a grip formed on one end side thereof, the frame portion being joined to the other end side of the shaft and forming a hitting face with a string being strung across; and a plurality of insertion holes that provide communication between an inner peripheral side surface and an outer peripheral side surface of the frame portion and through which the string is inserted, shock absorbing portions and hard portions being provided in an alternating fashion on at least a part of the outer peripheral side surface of the frame portion, each shock absorbing portion being formed between insertion holes that are adjacent to each other, each hard portion being formed between insertion holes that are adjacent to each other and being less elastically deformable than the shock absorbing portion.

Other aspects of the present invention shall be elucidated in the specification with reference to accompanying drawings.

DESCRIPTION OF EXEMPLARY EMBODIMENTS

Figure 1:
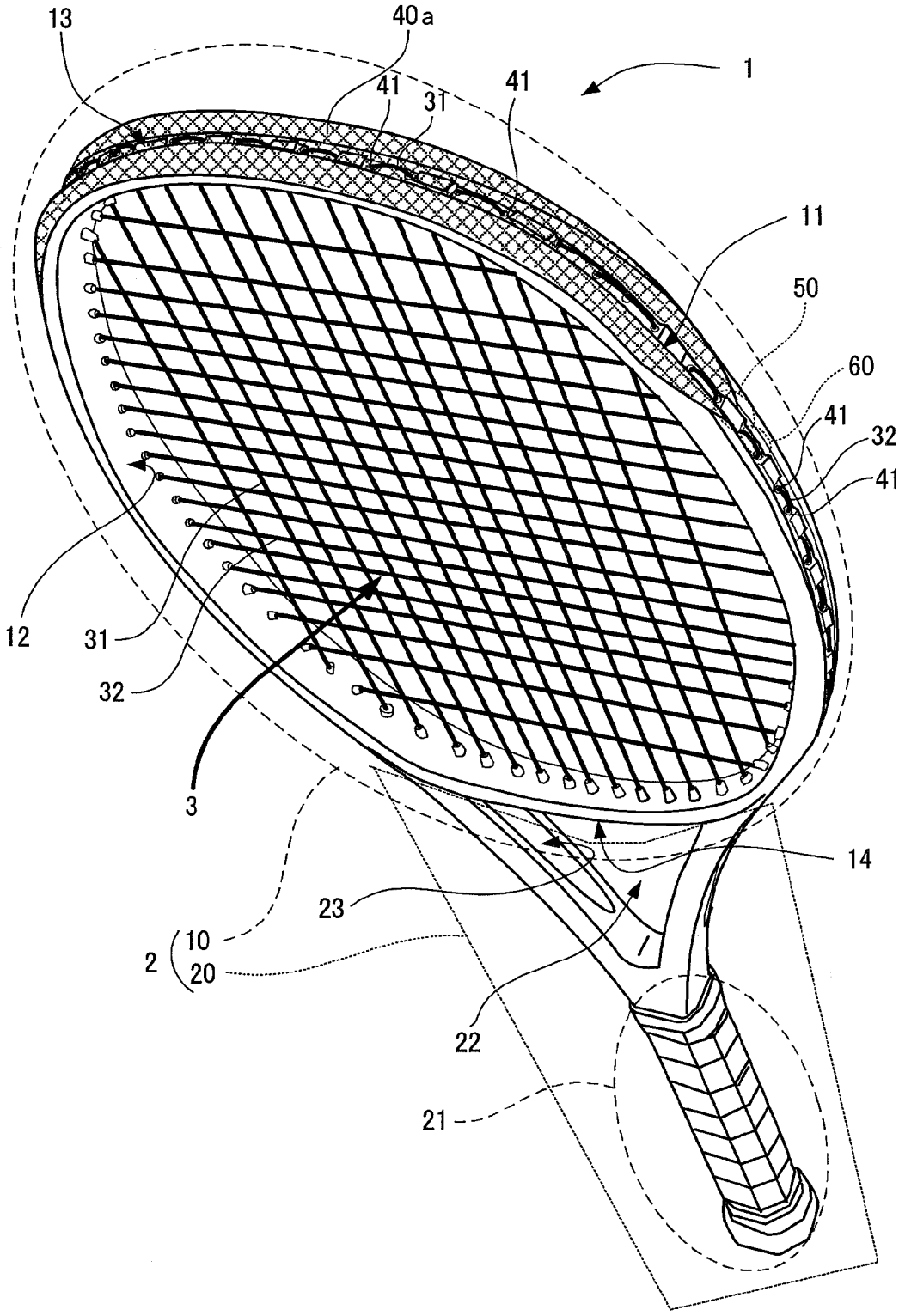
FIG. 1 is a perspective view of a racket of an embodiment of the present invention seen from a frame top side.

At least the following matters will be disclosed in the present specification and accompanying drawings.

As has been described above, recently, there is a need for a tennis racket that is cost effective and with which different hitting feels can be obtained easily. Accordingly, in order to meet such a need, the inventors considered that, basically using only one frame, it is necessary that different hitting feels can be obtained while maintaining a tension of a string. Further, the inventors considered that with the different hitting feels being achieved, it is desired to provide the racket with functions and performances that can widely meet the needs for the hitting feels for a variety of players with different skills, physical strengths and preferences. Aspects of the invention have been contrived based on such idea. The scope of the invention includes the above-mentioned main aspect of the invention, as well as a tennis racket having the features as follows:

The shock absorbing portion is made of a material that is more elastically deformable than a material of the hard portion. Alternatively, the shock absorbing portion is thicker than the hard portion;

The looped frame portion includes a frame main body portion forming a main body of the loop and a strip-like side surface member attached to an outer peripheral side surface of the frame main body portion, each of the insertion holes being a hollow portion of a hollow cylindrical tube portion, the side surface member having an opening of the insertion hole formed in a front surface thereof and is provided with the tube portion protruding from a back surface thereof, the frame main body portion being provided with guide holes and projections, each of the guide holes providing communication between the outer peripheral side surface and the inner peripheral side surface of the frame main body portion, the tube portion being inserted through the guide hole, the projections being alternately formed between the guide holes that are adjacent to each other, the shock absorbing portion being formed by attaching the side surface member to the outer peripheral side surface of the frame main body portion and deforming the front surface of the side surface member by each of the projections into a protruded shape that protrudes outwardly of the frame portion;

The string is strung across by being guided from an inner side of the looped frame portion via the insertion hole to an outer side of the looped frame portion, flexed back and then guided to the inner side via another insertion hole, the frame member being provided with an indicating portion that specifies either or both a stringing start position for a case in which the string is flexed back at the shock absorbing portion of the frame portion and a stringing start position for a case in which the string is flexed back at the hard portion;

With a direction normal to the hitting face being a front-back direction and a direction extending from the frame portion to the grip being an up-down direction, the frame portion is provided with regions having no shock absorbing portion formed therein arranged at four positions on the outer peripheral side surface at upper left, upper right, lower left and lower right thereof; and With a plane parallel to the hitting face being a flat plane, the shaft branches on the flat plane in a Y-shape from the grip side towards the frame portion and joins to the frame portion to form an opening portion that provides communication from a front side of the flat plane towards a depth direction, a hollow portion being formed in a side face of the shaft, the hollow portion providing communication in and out of the opening portion to arrange the insertion holes in a continuous manner along the loop shape of the frame portion.

Basic Structure of the Racket

Figure 2:
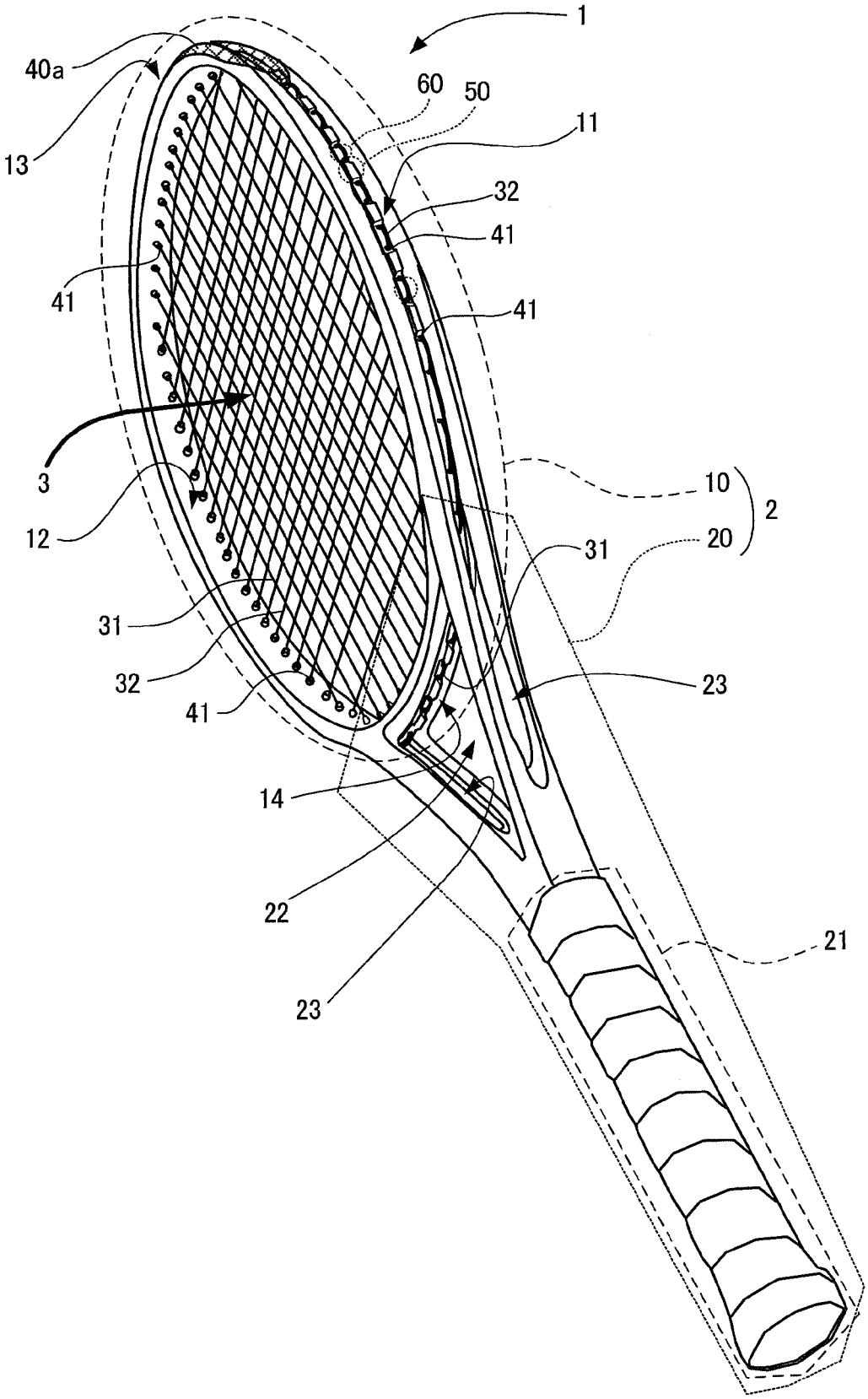
FIG. 2 is a perspective view of the above racket seen from a grip side.
Figures 3A, 3B:
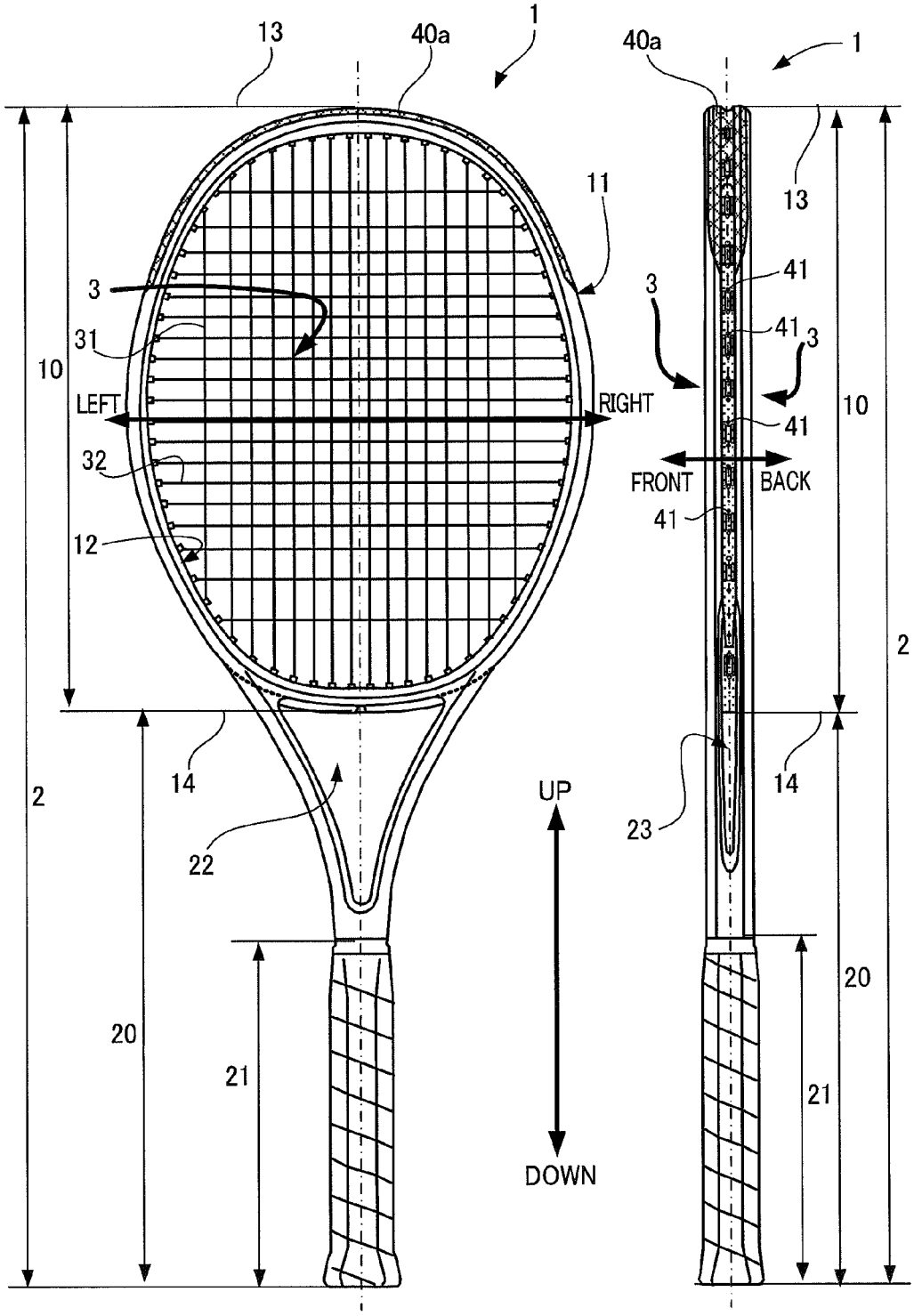
FIG. 3A is a plan view of the above racket and FIG. 3B is a side view of the above racket.

In FIGS. 1 and 2, external views of a tennis racket (hereinafter referred to as a racket 1) according to an embodiment of the present invention are illustrated. FIG. 1 is a perspective view of the racket 1 seen from a direction of a tip (racket top 13) of a loop portion 10. FIG. 2 is a perspective view of the racket 1 seen from a grip 21 side. In this specification, hereinafter, a direction along a normal to a hitting face is referred to as front-back direction, a direction extending from the racket top 13 to the grip 21 is referred to as a vertical direction (or an up-down direction or a longitudinal direction) and the grip 21 is provided at a lower side. A direction orthogonal to both the vertical direction and the direction along the normal to the hitting face is referred to as a left-right direction (or transverse direction). FIG. 3A illustrates a plan view of the racket 1 and FIG. 3B illustrates a side view of the racket 1. The above-mentioned each direction is indicated in FIGS. 3A and 3B.

The racket 1 of the present embodiment includes mainly a frame 2 that is formed by integrally joining a shaft 20 to a frame portion of a substantially elliptical shape (loop portion) 10. A net-like hitting face 3 is formed by stringing across a string (31, 32) in each of a lateral direction and a transverse direction and inwardly of the loop portion 10. The shaft 20 is formed in a continuous manner below the loop portion 10. It is to be noted that an end of the shaft serves as the grip 21 with a tape-like rubber and the like being wound thereon.

At the racket top 13, a cover made of resin (40*a*: a meshed hatching portion in the figure) that protects the loop portion 10 is attached. The substantially elliptical loop portion 10 is provided with insertion holes 41, through which the string (31, 32) is inserted, in a side surface (11, 12) thereof including the cover 40*a*.

The string (31, 32) includes a main string 31 that is strung across in a longitudinal direction and a cross string 32 that is strung across in a lateral direction each of which being guided to an outer side via a certain insertion hole 41 from an inner side of the loop portion 10, flexed back along a side surface of the loop portion 10 and then guided to an inner side of the loop portion 10 again via another insertion hole 41. In this manner, each of the longitudinal and lateral string (31, 32) is strung across at an inner side of the loop portion 10. Accordingly, the hitting face 3 is formed in which the string (31, 32) is strung across in a net-like manner.

The shaft 20 has a planar configuration of a Y-shape that branch upwardly to the left and right and a substantially triangular opening portion 22, which provides communication in the front-back direction, is formed by a lower end 14 of the loop portion 10 and the Y-shaped branching portion. In the present embodiment, the frame 2 has a special structure in which a cavity portion 23, which provides communication between an inner side and an outer side of the opening portion 22, is formed in the side surface of the shaft 20. A central portion of an outer peripheral side surface of the loop portion 10 continues in and out of the opening portion 22 of the shaft 20 via the cavity portion 23 and thus the insertion holes 41 are arranged along the substantially elliptical shape of the loop portion 10.

Structure of Insertion Hole

Figure 4:
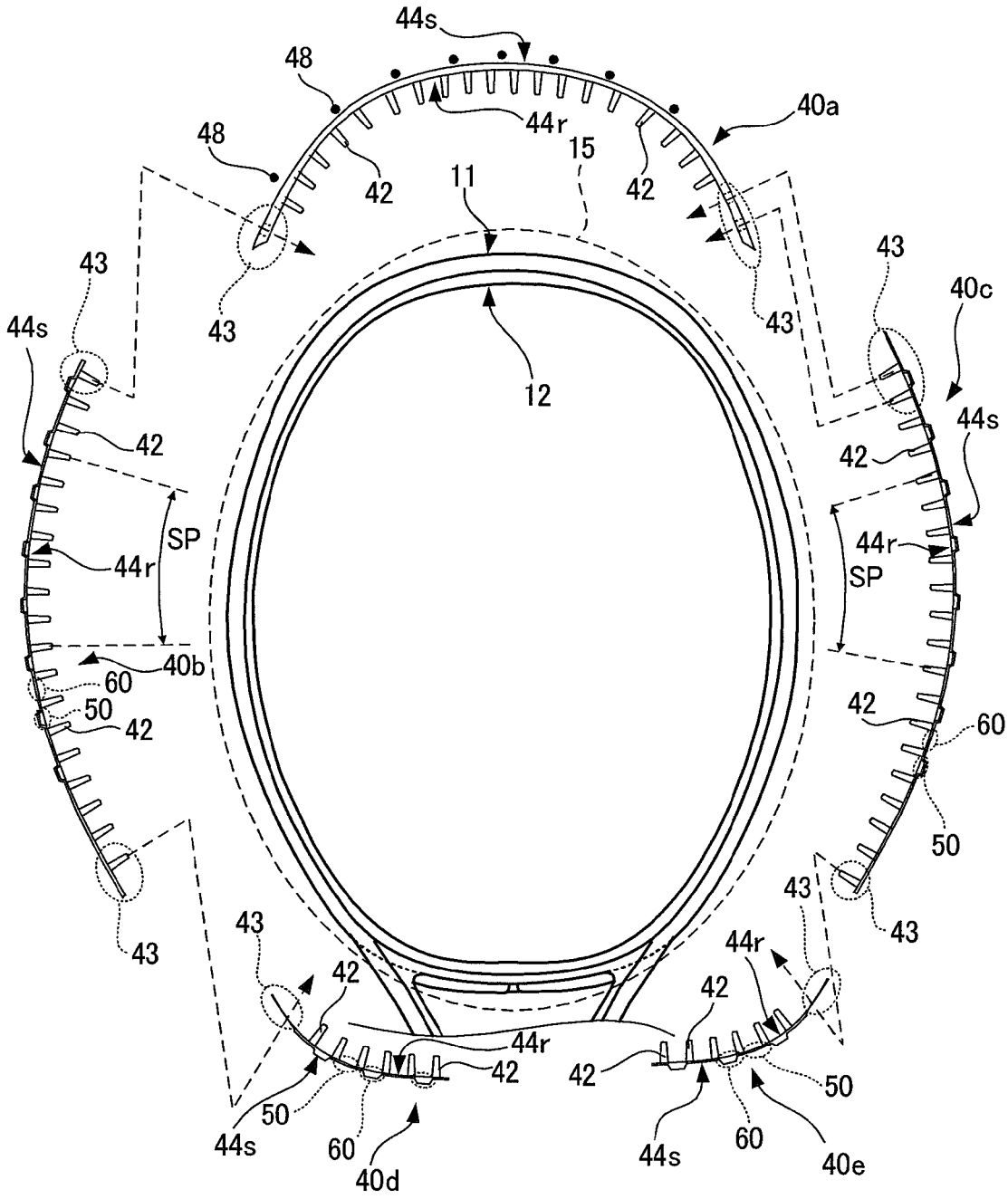
FIG. 4 is a diagram showing a structure of a loop portion of the above racket.
Figure 5:
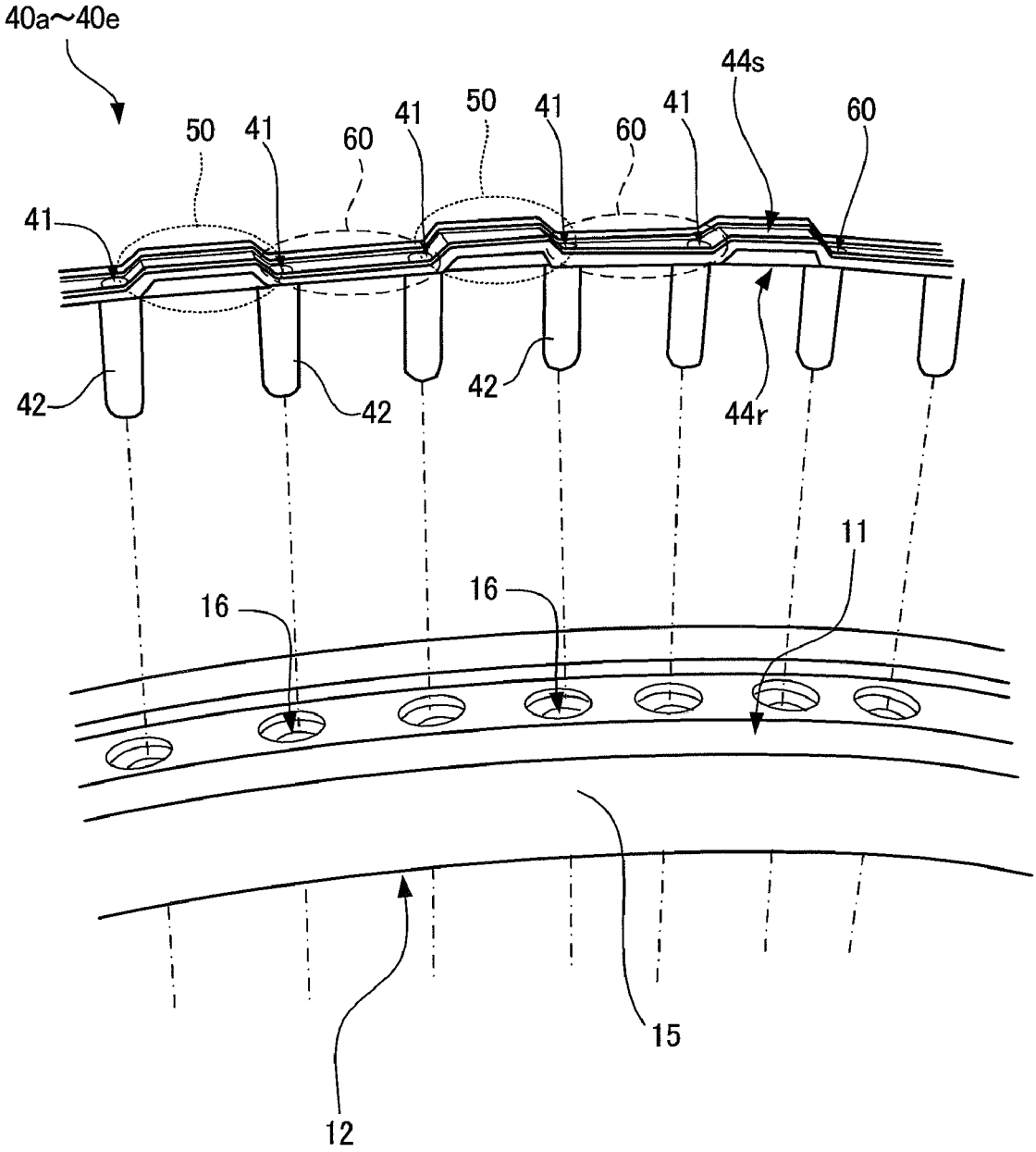
FIG. 5 is an enlarged view of the above loop portion.

FIG. 4 is a diagram showing a structure of the loop portion 10. In this diagram, the loop portion 10 is illustrated as an exploded view showing components forming the loop portion 10. FIG. 5 is an enlarged view for explaining the structure of the loop portion 10. As shown in these diagrams, the loop portion 10 includes a portion that forms a main body of a substantially elliptical frame portion (frame main body portion) 15 and a strip-like member (grommet member: 40*a*-40*e*) that is attached to an outer periphery of the frame main body portion 15. The insertion hole 41 is not provided by directly perforating a hole in the loop portion 10. The insertion hole 41 is a hollow portion of a tube (hereinafter referred to as a grommet) 42 inserted through a hole (guide hole) provided in the loop portion 10. The grommet 42 is inserted through the guide hole 16 with a tip end being protruded inwardly of the loop portion 10, and the string (31, 32) is passed through the hollow portion of the grommet 42. The grommets 42 are provided in a protruded manner on a surface (back surface) that is attached to the frame main body portion 15 of a strip-like grommet member (40*a*-40*e*) so as to align in a longitudinal direction of the strip. Further, one of the openings of the insertion hole 41 is formed in a front surface of the grommet member (40*a*-40*e*).

In this example, five grommet members (40*a*-40*e*) are attached to a periphery of the frame main body portion 15 and, as shown in FIG. 1, the grommet member 40*a* at an upper part also serves as a cover 40*a* that protects the racket top 13. Also, each grommet member (40*a*-40*e*) is connected to each other with the grommet 42 of one of the grommet members (40*a*-40*e*) that are adjacent to each other being, at an end portion 43 of the strip-like member, inserted through a hole provided at an end portion 43 of the other grommet member (40*a*-40*e*).

Hitting Feel Selecting Function

As has been described above, the racket 1 of the present embodiment can provide different hitting feels to a player without changing tensions of the strings (31, 32) for a single frame 2. The racket 1 of the present embodiment achieves a hitting feel selecting function that enables a selection between either a "hard" hitting feel or a "soft" hitting feel by contriving the structure of the grommet member (40*a*-40*e*).

Hereinafter, the hitting feel selecting function of the racket of the present embodiment will be described. As shown in FIGS. 4 and 5, on a front surface 44*s* of the grommet member (40*a*-40*e*), a portion between openings of the two insertion holes 41 that are adjacent to each other, i.e., a portion that comes into contact with the string (31, 32) that is flexed back, protrudes outwardly in a trapezoidal shape in an alternating fashion. The front surface 44*s* of the strip-like grommet member (40*a*-40*e*) has a shape that alternately protrudes and recesses along a direction of extension of the strip. The grommet member 40*a* that also serves as a top cover is provided with protruded portions 50 formed at positions 48 indicated by black circles in FIG. 4. In the present embodiment, the grommet member (40*a*-40*e*) is configured in such a manner that, when attached to the frame main body portion 15, the above-mentioned protrusions and recesses are not continuously formed on the entire periphery of the loop portion 10 but there is a region at a part of the loop portion 10 in which, among the protrusions and the recesses, only recessed portions 60 are formed. On the periphery of the loop portion 10, the protruded portions 50 are formed in left-right and upper and lower pairs, respectively. With the hitting feel selecting function of the present embodiment, when stringing the string (31, 32) across the loop portion 10, different hitting feels are obtained for a case in which the string (31, 32) is flexed back at the trapezoidal protruded portions 50 and for a case in which the string (31, 32) is flexed back at recessed portions 60.

Specifically, the trapezoidal protruded portion 50 is more elastically deformable compared to the recessed portion 60. Accordingly, in a case where the string (31, 32) is flexed back at this protruded portion 50, when a ball hits the hitting face 3, the string (31, 32) exerts a force directed inwardly of the loop portion 10 onto the flexing back portion (50, 60) due to an impulsion. The trapezoidal protruded portion 50 is more elastically deformable than the recessed portion 60 and thus elastically deforms due to a force produced by the string (31, 32) and provides a shock absorbing function.

In other words, in a case where the string (31, 32) flexes back at the protruded portion 50, the protruded portion 50 serves as a "shock absorbing portion" 50 that alleviates the shock from the ball and, as a result, a soft hitting feel can be obtained. On the other hand, in a case where the string (31, 32) is strung by flexing back at the recessed portion 60, since an elastic deformation due to the shock from the ball is less likely to occur, a solid hitting feel is obtained. That is to say, the recessed portion 60 functions as a "hard portion 60" having a hard property.

In the present embodiment, a difficulty level of elastic deformation is relatively altered between the hard portion 60 and the shock absorbing portion 50 by manufacturing the grommet member (40*a*-40*e*) by double molding of a hard resin forming the hard portion 60 and a soft resin forming the shock absorbing portion 50. In this example, Pebax (Trade Mark) including a polyether block amide copolymer is used as a double mold resin in which the hard resin is Pebax 7033 and the soft resin is Pebax 3533.

Further, in the present embodiment, as for the string (31, 32) strung across a central portion of the loop portion 10, i.e., a region which is a so-called sweet spot, the grommets 42 at the central eight positions of the left and right grommet members (40*b*, 40*c*) at which the cross string 32 is strung across (in FIG. 4, a portion labeled "SP") are "soft grommets" that are formed of the soft resin forming the shock absorbing portion 50. As for the main string 31, the grommets 42 of the grommet member 40*a* which also serves as a cover of the loop portion 10 are all formed of a "hard grommet" formed of the same resin as the hard portion 60, whereas the grommets 42 of the grommet member (40*d*, 40*e*) at the lower end 14 of the loop portion 10 are all "soft grommets". In this manner, by forming a part of the grommets 42 with the soft resin, the hitting feel is prevented from being too hard even in a case where the hard feel is selected.

Figure 6A:
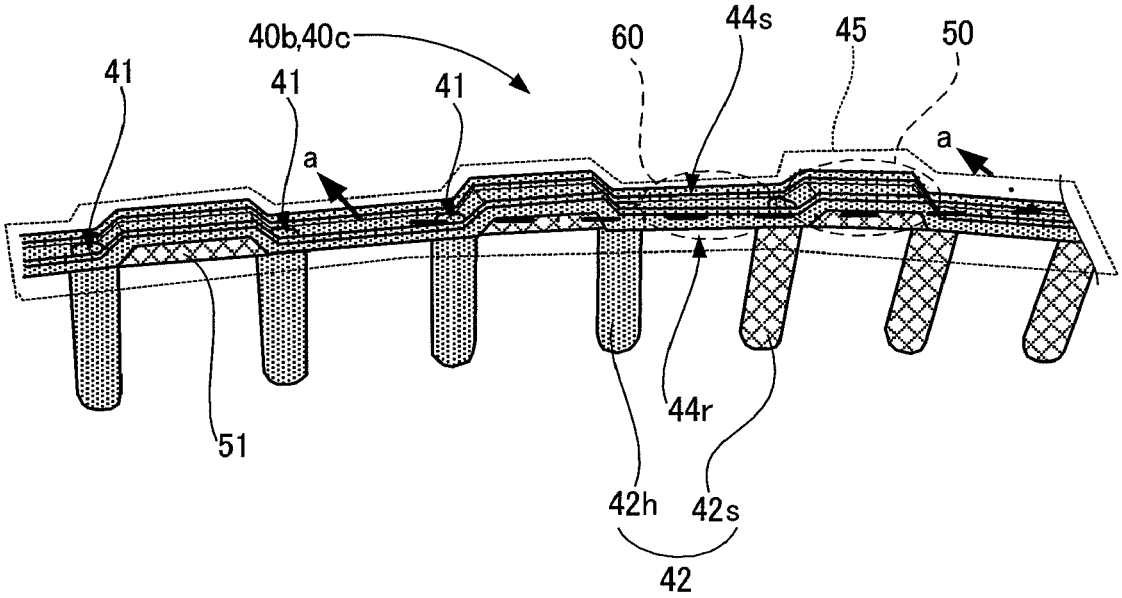
FIGS. 6A and 6B are diagrams showing a structure of a shock absorbing portion formed in a grommet member that constitutes the above loop portion.
Figure 6B:
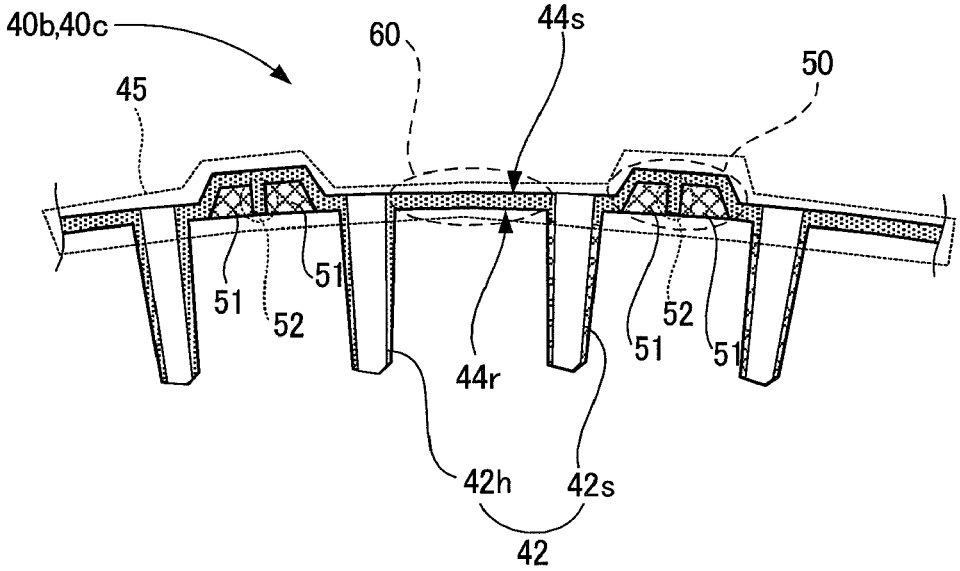

In FIGS. 6A and 6B, as a reference, a detailed structure of the grommet member (40*a*-40*e*) and the grommets 42 is illustrated by taking the left and right grommet members (40*b*, 40*c*) as an example. FIG. 6A is an enlarged perspective view of a part of the grommet member (40*b*, 40*c*) and FIG. 6B is a cross-sectional view taken along a-a arrows in FIG. 6A. In the present embodiment, a strip-like portion 45 of the grommet member (40*b*, 40*c*) and the above-mentioned hard grommets 42*h* are made of the hard resin (in the figure, dotted hatching portions). The strip-like portion 45 of a hard resin is alternately bent in a cranked shape along its direction of extension and, on its back surface 44*r*, the soft resin 51 (in the Figure, meshed hatching portions) is filled by double molding at positions corresponding to recessed portions of the cranks. In this manner, a portion protruding trapezoidally on a front surface 44*s* of the grommet member (40*b*, 40*c*) becomes the shock absorbing portion 50. It is to be noted that the soft grommet 42*s* corresponding to the above-mentioned sweet spot is also made of the soft resin which is the same as the shock absorbing portion 50.

Further, in an example shown in FIGS. 6A and 6B, at a portion corresponding to the recessed portion of the crank on the back surface of the strip-like portion 45 of the above-mentioned hard resin is provided with a column 52 that is integrally formed and made of the same hard resin, and the column 52 is embedded in the soft resin 51. Thus, the shock absorbing portion 50 is prevented from excessively deforming even in a case where the string (31, 32) is flexed back on the shock absorbing portion 50.

How to String in Accordance with the Hitting Feel

As has been described above, the above-mentioned racket 1 can obtain different hitting feels by appropriately selecting the insertion holes 42 through which the strings (31, 32) are to be inserted through and thus selecting whether to flex back on the shock absorbing portions 50 or on hard portions 60 when stringing the strings (31, 32) across the loop portion 10.

Figure 7:
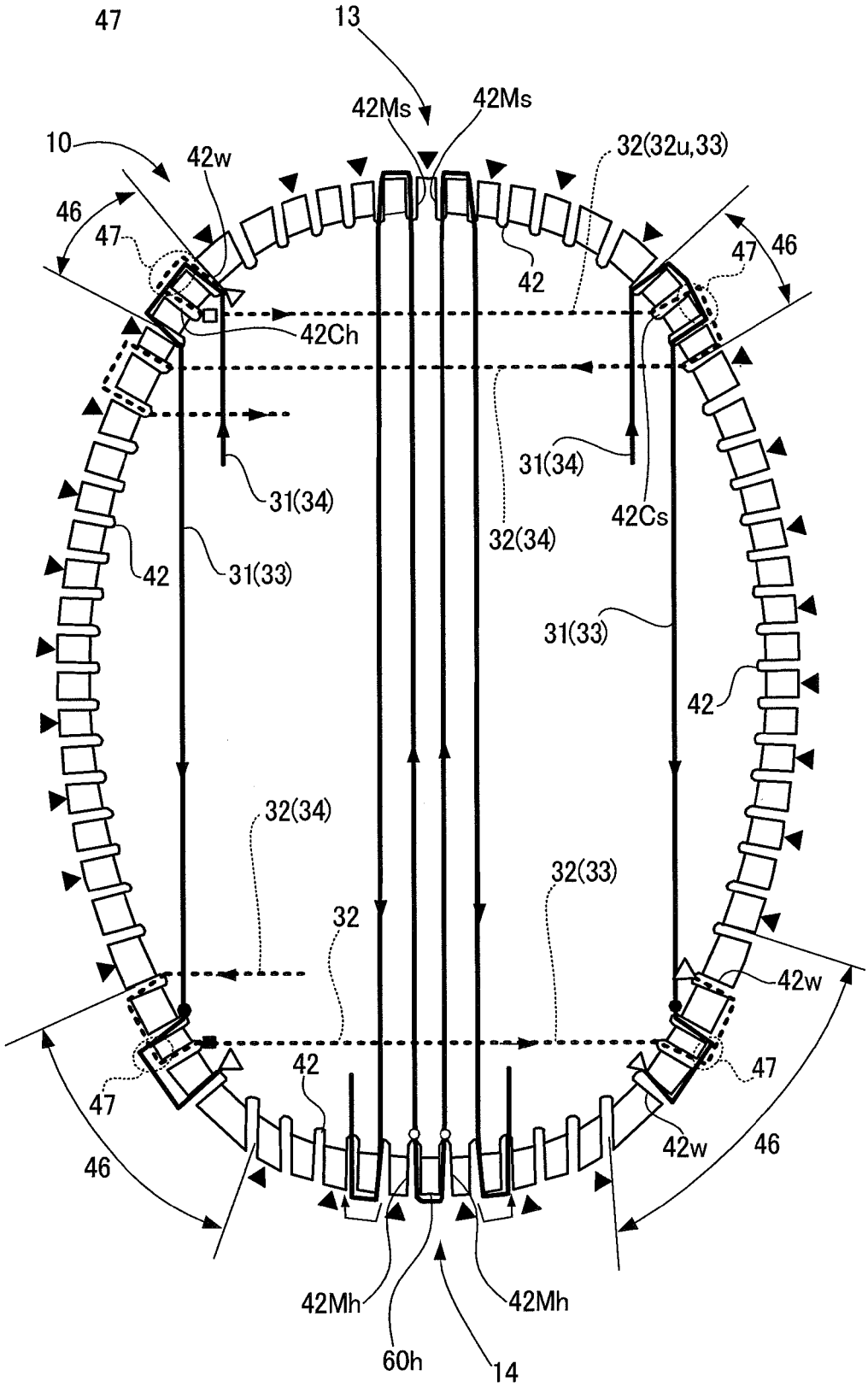
FIG. 7 is a diagram showing a stringing start position and a stringing end position for the above racket in a case of obtaining a hard hitting feel.
Figure 8:
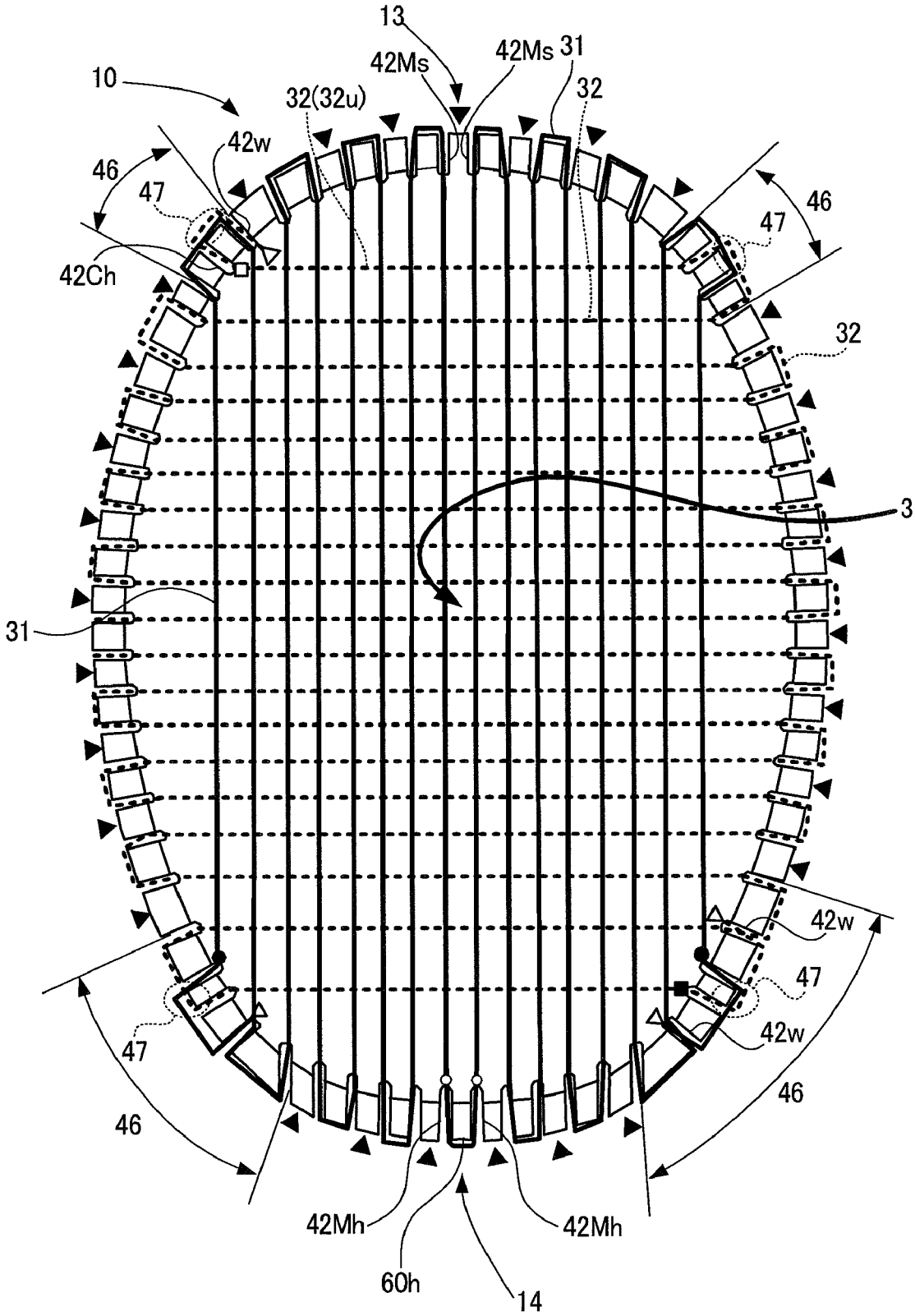
FIG. 8 is a diagram showing how a string is stringed in the case of obtaining the hard hitting feel.
Figure 9:
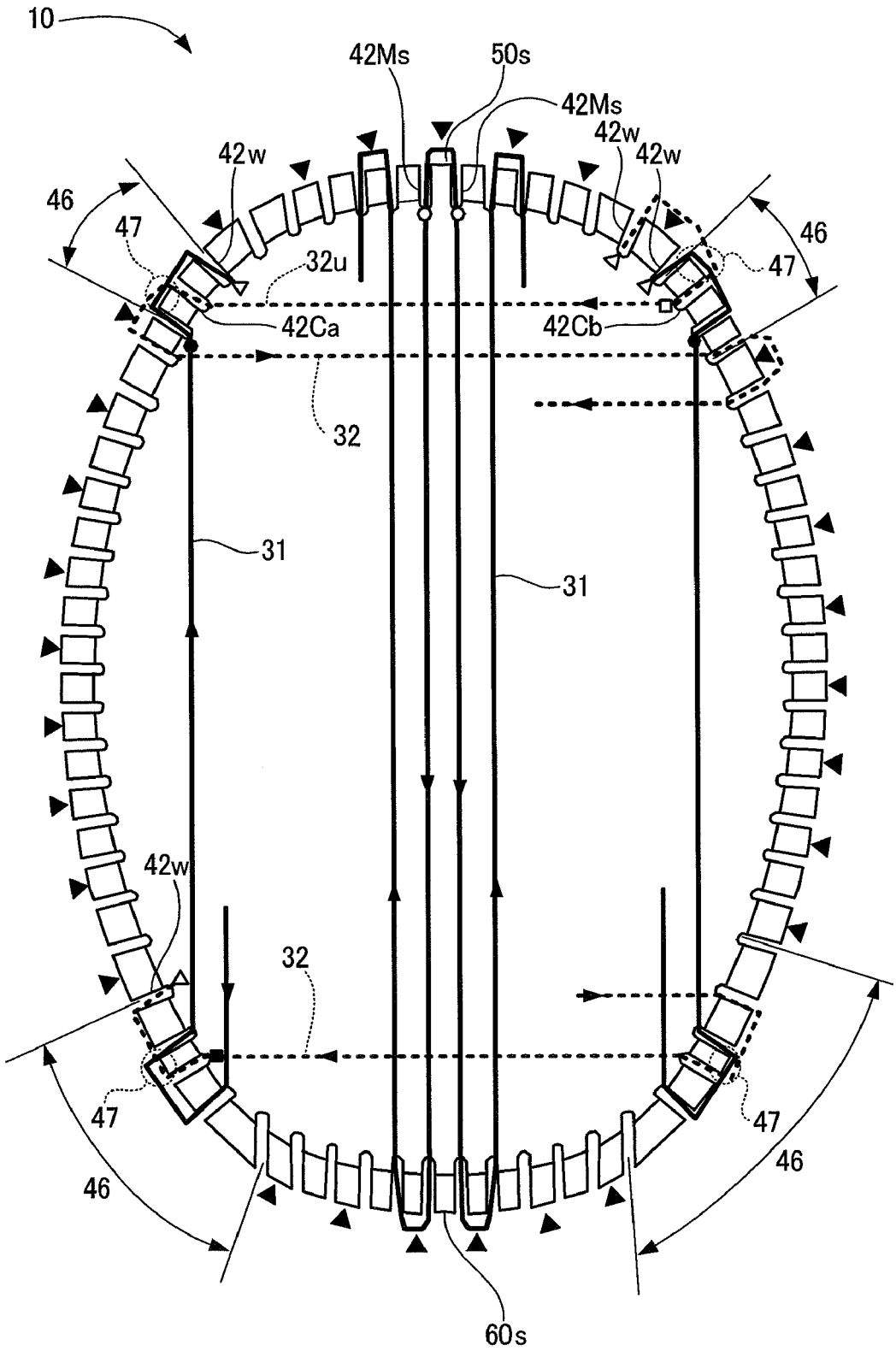
FIG. 9 is a diagram showing a stringing start position and a stringing end position for the above racket in a case of obtaining a soft hitting feel.
Figure 10:
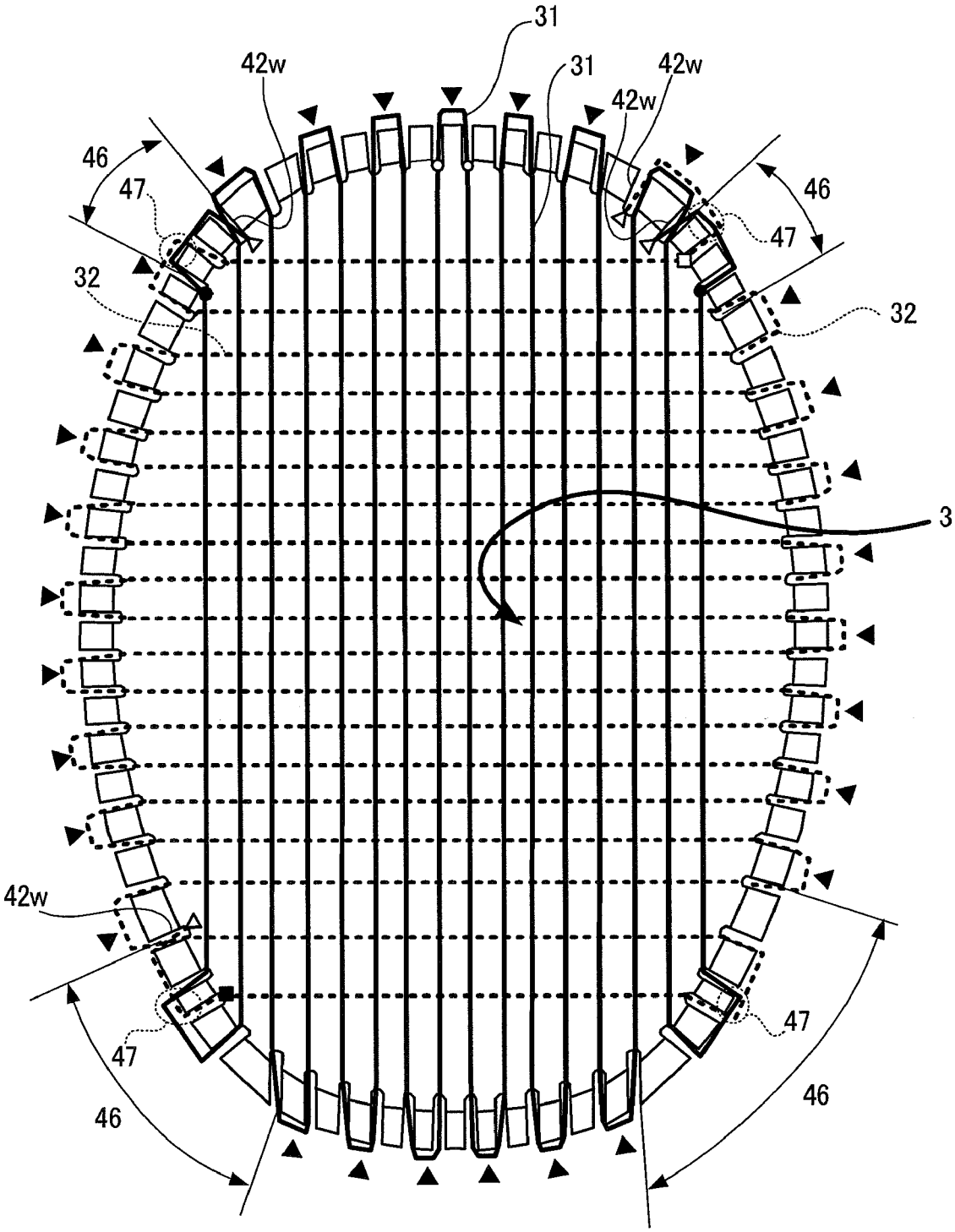
FIG. 10 is a diagram showing how a string is stringed in the case of obtaining the soft hitting feel.

In FIGS. 7 to 10, stringing positions of the string (31, 32) corresponding to two types of hitting feels, i.e., "hard" and "soft", is shown. FIGS. 7 and 8 illustrate a stringing fashion of the string (31, 32) in a case of obtaining the hard hitting feel and FIGS. 9 and 10 illustrate a stringing fashion of the strings (31, 32) in a case of obtaining the soft hitting feel. FIGS. 7 and 9 show stringing start positions and stringing end positions of the string (31, 32) for the stringing fashion of the string (31, 32) corresponding to the respective hitting feels. FIGS. 8 and 10 show states in which the strings (31, 32) are strung across the loop portion 10 and the hitting face 3 is formed. In these figures, the main string 31 is indicated by solid lines and the cross string 32 is indicated by dotted lines. Black triangles are indicated at positions where the shock absorbing portions 50 are formed.

Further, the grommet 42 that firstly guides the string (31, 32) from an outer side to an inner side of the loop portion 10 is taken as a stringing start position and the grommet 42 that lastly guides the string (31, 32) from an inner side to an outer side of the loop portion 10 is taken as a stringing end position. The stringing start position and the stringing end position of the main string 31 are indicated by a white circle and a black circle, respectively, and the stringing start position and the stringing end position of the cross string 32 are indicated by a white square and a black square, respectively. Knots of the string (31, 32) are indicated with white triangles.

In the present embodiment, the shock absorbing portion 50 and the hard portion 60 are, except for a part such as a part 46 near the stringing end position of the string (31, 32), arranged to surely oppose each other at the left and right and at the top and bottom, and when the string (31, 32) is inserted through the grommets 42 at opposing positions in the up-down direction and the left-right direction, it flexes back on either the shock absorbing portion 50 or the hard portion 60.

The main string 31 is strung across in a left-right symmetrical manner from the top end 13 or the bottom end 14 of the loop portion 10 and the cross string 32 is strung across from either a left or right upper portion of the loop portion 10 towards a lower portion in a meandering manner. In the case of the stringing fashion for the hard hitting feel, as shown in FIG. 7, the main string 31 is inserted through the grommets 42Mh on both side of a hard portion 60*h* at the center of the bottom end 14 of the loop portion 10 and strung across in a left-right symmetrical manner. In order to obtain the soft hitting feel, as shown in FIG. 9, stringing is started by guiding the main string 31 inwardly of the loop portion 10 from the grommets 42Ms on both sides of a shock absorbing portion 50*s* at the center of the top end 13 of the loop portion 10. The cross string 32 is strung across in such a manner that, when a cross string 32*u* that is strung at the upper most level in the hitting face 3 is started stringing from either one (42Ch, 42Cs) of the left-right both end grommets (42Ch, 42Cs) of the loop portion 10, it flexes back at the hard portions 60 and, when started stringing from the other (42Cs, 42Ch), it flexes back at the shock absorbing portions 50.

Measurement of Hitting Feel

The racket 1 of the present embodiment provides different hitting feels in response to the stringing fashion of the strings (31, 32). Accordingly, using the same frame 2, a difference in the hitting feels was actually measured for cases in which the string (31, 32) was strung with two stringing fashions to obtain different hitting feels. Of course, the tension for stringing the string (31, 32) across was made the same. As for the hitting feel, measurement was taken for two properties, i.e., a cushioning characteristic and a shock range. The cushioning characteristic indicates the difficulty level of relative deformation between the hard portion 60 and the shock absorbing portion 50 and is a deformation ratio in a thickness direction at the strip-like portion 45 of the grommet member (40*a*-40*e*). The shock range is a maximum amplitude obtained when a ball is dropped from a predetermined height to a center of the hitting face 3 and the string (31, 32) is vibrated while the hitting face 3 of the racket 1 is held horizontally. Both measured properties are indicated by relative values by taking a numerical value of a case where the string is strung with the hard hitting feel as 100.

Table 1 below shows the result of the measurement.

TABLE 1

| | Flexed back portion of the string | |
|---|---|---|
| | Hard portion | Shock absorbing portion |
| Cushioning characteristic | 100 | 125 |
| Shock range | 100 | 86 |

It can be seen from Table 1 that, depending on the stringing position of the string (31, 32), there is a significant difference between the hitting feels. In other words, according to the racket 1 of the present embodiment, significantly different two types of hitting feels can be obtained with the single frame 2.

Position at which Shock Absorbing Portion is Formed

As has been described above, in the present embodiment, the shock absorbing portion 50 and the hard portion 60 are arranged so as to surely oppose at the left and right and at the top and bottom of the loop portion 10, except for the part 46 such as near the stringing end position of the string (31, 32). In other words, on the outer peripheral side surface 11 of the loop portion 10, the shock absorbing portion 50 and the hard portion 60 are not provided continuously along the entire side surface of the loop. Specifically, explaining with reference to FIGS. 7 to 10, regions 46 in which the shock absorbing portion 50 is not formed are provided at four portions at upper left, upper right, lower left and lower right of the outer peripheral side surface of the loop portion 10. These regions 46 are, for example, around the grommet 42*w* in which a total of two strings, which may be one main string and one cross string, two main strings or two cross strings, are inserted at the same time or a region 47 in which the main string 31 and the cross string 32 cross over at an outer periphery of the loop portion 10.

The region 46 in which the shock absorbing portion 50 is not formed corresponds to the stringing end portion of the main string 31 and to the stringing start position and the stringing end position of the cross string 32. In a case where the shock absorbing portion 50 exists at this position, when the string (31, 32) is strung for the hard hitting feel, the outer most string 33 and the second one from the outer most string 34 in the hitting face 3 flex back on the shock absorbing portions 50 as shown in FIG. 7.

Normally, when the ball is hit outside the sweet spot, as the string (31, 32) strung across in up-down and left-right directions gradually becomes shorter from the center of the hitting face 3 towards a direction of the frame of the loop portion 10, the hitting feel also gradually becomes harder. However, in a case where the outer most string 33 and the second one from the outer most string 34 in the hitting face 3 flex back on the shock absorbing portions 50, while the hitting feel is being hardened gradually, the hitting feel may be inverted and may sharply become soft. If the hitting feel changes sharply, the hitting feel expected by the player will be impaired. Also, if the hitting feel changes, it will of course become difficult to control the direction and the speed of the ball. Accordingly, in the present embodiment, as has been described above, the region 46 in which the shock absorbing portion 50 is deliberately not formed is provided, and the string (31, 32) is prevented from flexing back at any of the shock absorbing portions 50 when the string (31, 32) is strung across for the hard hitting feel.

Stringing Position Indication

According to the racket 1 of the present embodiment, different hitting feels can be obtained with the single frame 2 by simply changing stringing fashion or the stringing start position of the string (31, 32). In order not to start from a wrong stringing start position, on a front surface (back surface) of the loop portion 10, marks are indicated at start stringing positions corresponding to the hitting feels.

Figure 11:
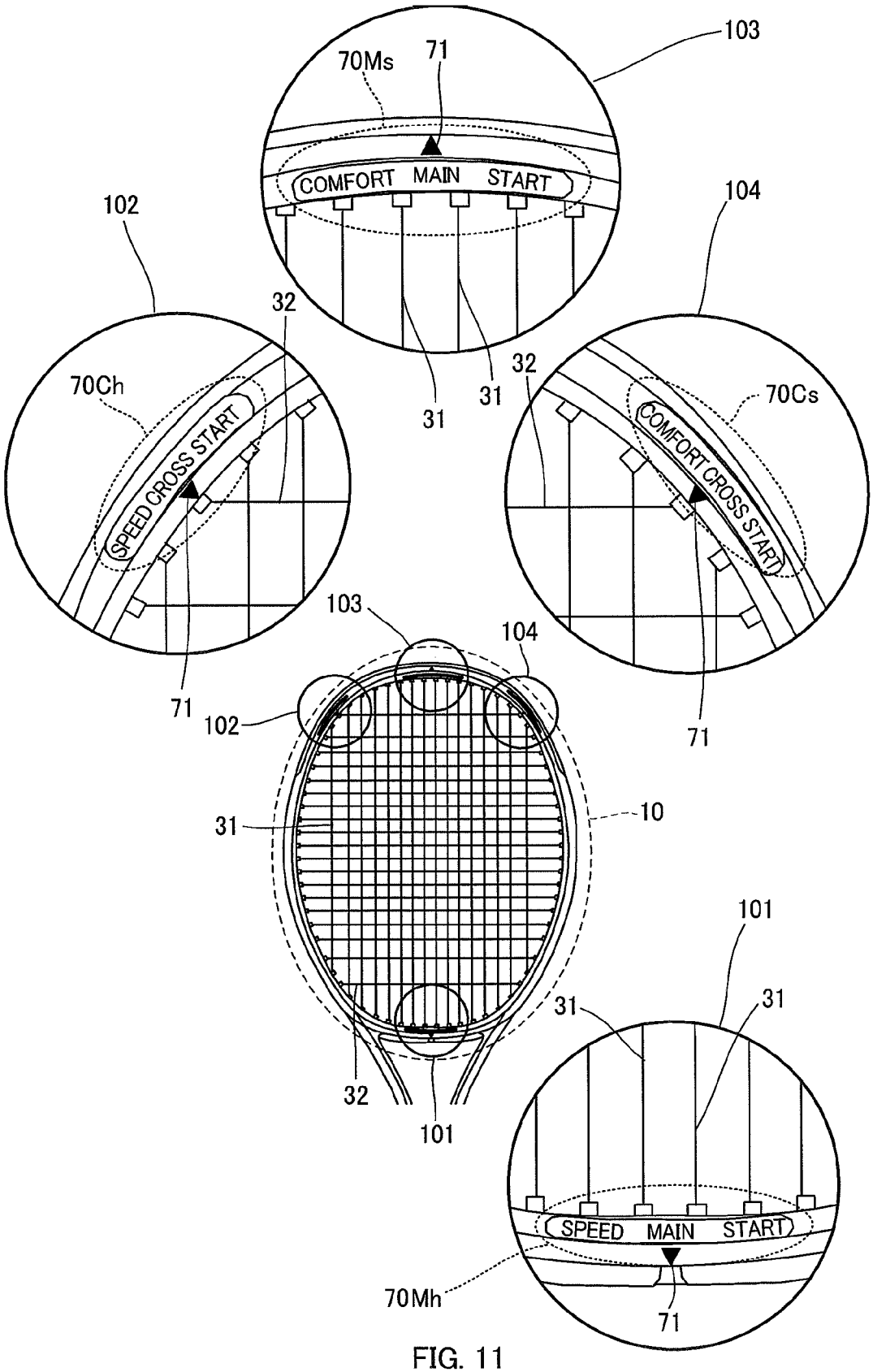
FIG. 11 is a diagram showing marks indicating the stringing start positions.

In FIG. 11, marks 70Mh, 70Ch, 70Ms, 70Cs are shown. In this example, at four portions (101-104) of the front surface of the loop portion 10 along the elliptical shape of the loop portion 10, the marks (70Mh, 70Ch) specifying stringing start positions for the main string 31 and the cross string 32, respectively, for obtaining the hard hitting feel, and the marks (70Ms, 70Cs) specifying stringing start positions for the main string 31 and the cross string 32, respectively, for obtaining the soft hitting feel are indicated. In this example, a black triangle 71 indicating a position of the grommet 42 to start stringing is indicated, and, at a position of the black triangle 71, the hitting feel that can be obtained when the string (31, 32) is strung across is indicated in accordance with the mark (70Mh, 70Ch, 70Ms, 70Cs). In this example, the hard hitting feel is expressed by a word "SPEED" and the soft hitting feel is expressed by a word "COMFORT". Further, depending on whether the string (31, 32) to be started stringing is longitudinal or lateral, a word "MAIN" or "CROSS" is indicated. It is to be noted that the marks 70Mh, 70Ch, 70Ms, 70Cs need not indicate both of the two hitting feels, i.e., hard or soft, and only one of the hitting feel may be indicated.

Of course, it is not necessary that the main string 31 and the cross string 32 are both strung across for the same hitting feel. For example, the main string 31 may be strung across to flex back on the hard portions 60 and the cross strings 32 may be strung across to flex back on the shock absorbing portion 50 to enable freedom in customization in accordance with a user's choice or preference. Thus, even in a case in which the stringing positions of the string (31, 32) differ for the main string and the cross string, the stringing positions will not be mistaken with the above-mentioned marks (70Mh, 70Ch, 70Ms, 70Cs).

Structure of Shaft

As has been described above, according to the racket 1 of the present embodiment, the substantially elliptical shape providing a contour of the loop portion 10 continues in and out of the opening 22 via the hollow portion 23 provided in the side surface of the shaft 20, and the insertion holes 41 are arranged in a continuous manner along the shape of the loop. This shaft structure also improves properties related to the hitting feel.

Figure 12:
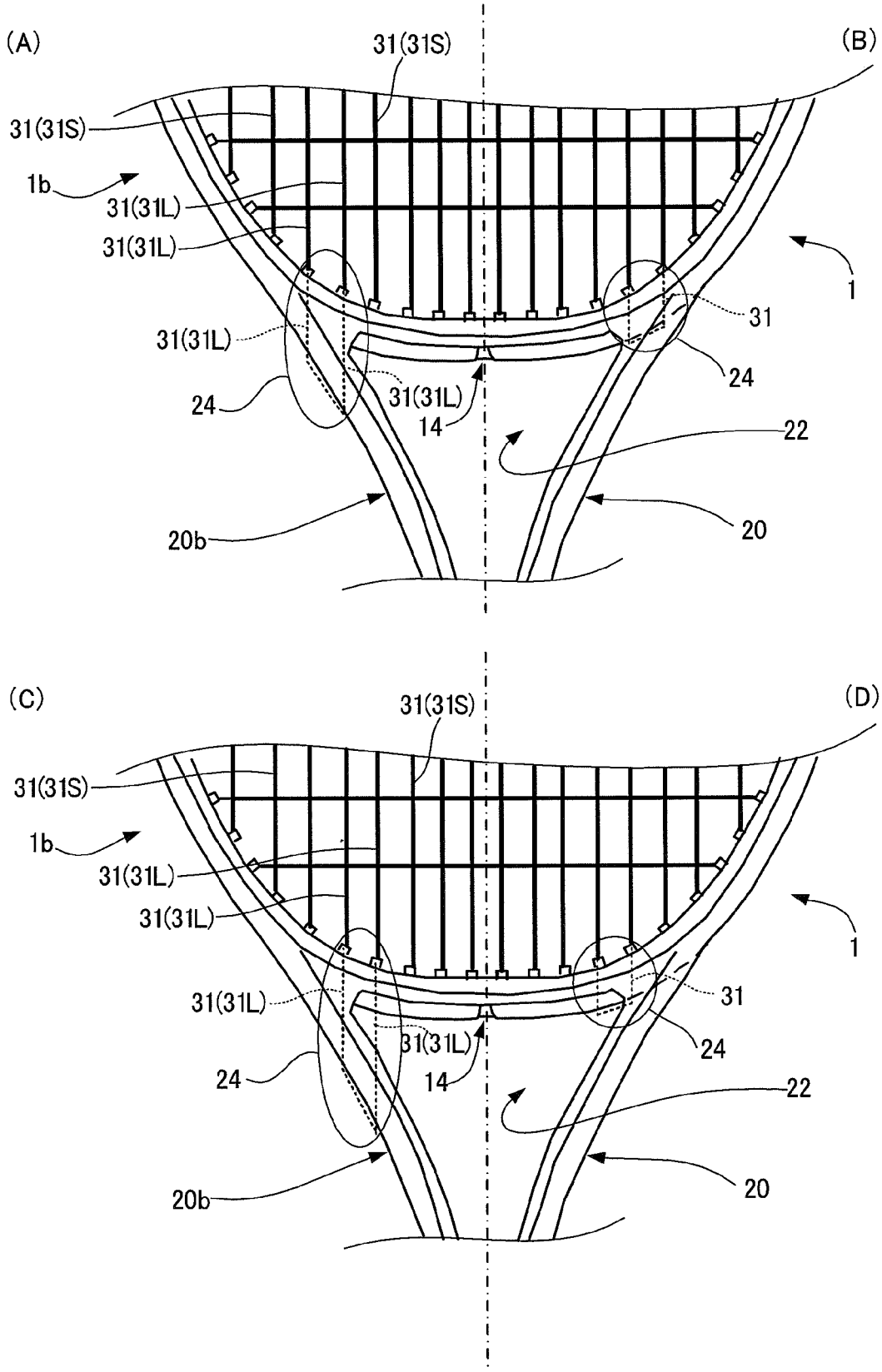
FIG. 12 is a diagram showing a relationship between a shaft structure and a stringing state of the racket.

FIG. 12 shows how the string (31, 32) is strung across in accordance with the structure of the shaft 20. Part (A) and part (B) show how the strings (31, 32) are strung across to obtain the soft hitting feel and part (C) and part (D) show how the strings (31, 32) are strung across to obtain the hard hitting feel. Also, part (A) and part (C) show a stringing fashion for a known racket 1*b*, and part (B) and part (D) show a stringing fashion for the racket 1 of the present embodiment.

With the stringing fashion of the known racket 1*b* shown in part (A) and part (C), since a shaft 20*b* does not have the hollow portion 23, the main string 31 will flex back through the shaft 20*b* and thus a length of a main string 31L strung at a joining portion 24 between the shaft 20*b* and the loop portion 10 and a length of a main string 31S that is adjacent to the main string 31L and that is flexed back along an ellipse will be extremely different. Accordingly, while the string becomes gradually shorter from the center of the hitting face 3 towards the frame portion of the loop portion 10, the main string 31 will become extremely long and thus the hitting feel will be discontinuous from the center of the hitting face 3 towards the frame portion. Therefore, there is a possibility that it becomes difficult to control the ball.

On the other hand, according to the racket 1 of the present embodiment shown in part (B) and part (D), the hollow portion 23 is provided in the side surface of the shaft 20 and the main string 31 flexes back along the substantially elliptical shape of the loop portion 10 also at the joining portion 24 between the shaft 20 and the loop portion 10. Accordingly, the main string 31 becomes gradually shorter from the center of the loop portion 10 towards the frame portion direction and the hitting feel gradually changes from the sweet spot at the center of the hitting face 3 towards an outward direction.

Further, with the racket 1 of the present embodiment, different hitting feels can be obtained by changing the stringing start positions of the main string 31 for the top and bottom of the loop portion 1 and it is the shaft structure of the present embodiment that substantially enables the change in the stringing start position. Specifically, the cross string 32 is not influenced by the structure of the shaft 20 since it may be started stringing from either the top left or top right end of the loop portion 10 depending on the different hitting feels. However, as has been shown in part (C) and part (D) of FIG. 12, in a case where main string 31 is being started stringing from the center of the bottom end 14 of the loop portion 10 to obtain the hard hitting feel, with the known shaft 20*b* without the hollow portion 23 as shown in part (C), the main string 31L will be strung across by traversing the opening 22 and thus it will be a substantially impossible stringing fashion. That is to say, according the racket 1 of the present embodiment, due to its special shaft structure, different hitting feels can be obtained by changing the stringing start position of the main string 31, which is a method that could not be expected in the past.

Structure of Shock Absorbing Portion

Figure 13:
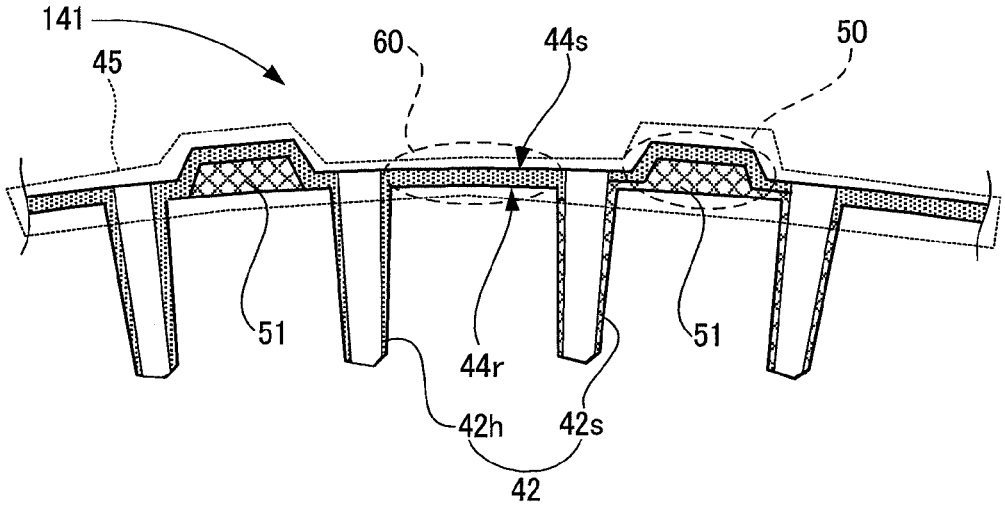
FIG. 13 is a diagram showing a variant of the grommet member.

In the embodiment described above, the grommet member (40*a*-40*e*) formed by double molding is attached to the frame main body portion 15, which is a main body of the loop portion 10, and thus the hard resin and the soft resin are selectively provided at positions where the string (31, 32)

flexes back. There are grommets 42 through which the insertion holes 41 penetrate that are made of the soft resin and that are made of the hard resin. Accordingly, as in the grommet member 141 shown in FIG. 13, for a portion at which the grommets 42*s* made of the soft resin are provided on both sides of the shock absorbing portion 50, the soft resin 51 portion that forms the shock absorbing portion 50 and the grommets 42*s* may be formed in an integrated manner.

Further, in the embodiment described above, the shock absorbing portion 50 made of the soft resin protrudes in a trapezoidal shape outwardly of the loop portion 10. However, it is not limited to such a configuration but may be any structure as long as the difficulty level of elastic deformation of the flexed back portion is relatively different when the string (31, 32) flexes back along the side surface of the loop portion 10.

Figure 14:
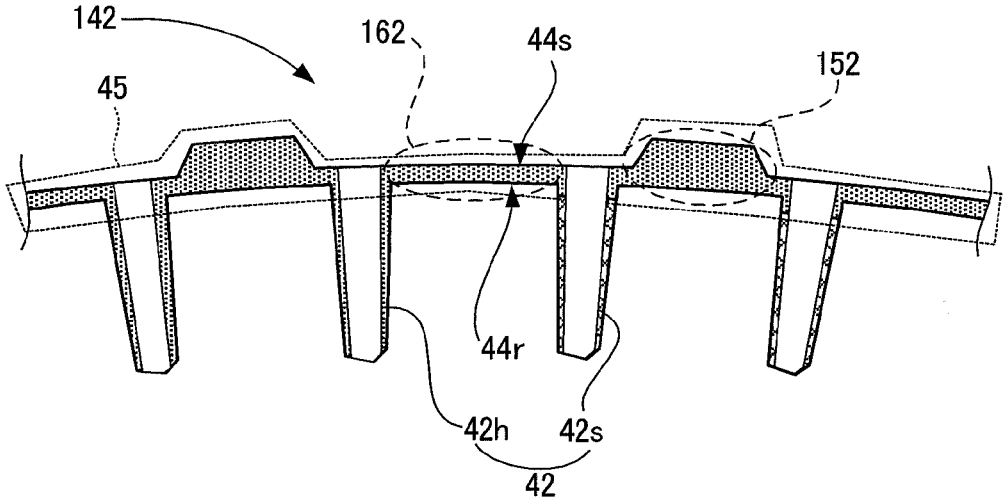
FIG. 14 is a diagram showing another variant of the grommet member.
Figure 15:
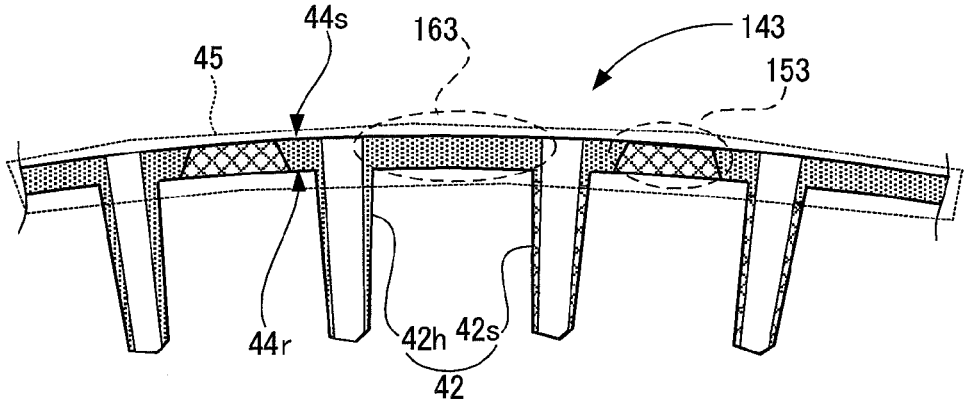
FIG. 15 is a diagram showing still another variant of the grommet member.

For example, as in the grommet member 142 shown in FIG. 14, in a case where the entire strip-like portion 45 is made of the hard resin, protrusions and recesses can be formed on the strip-like portion 45 and the protruded portion 152 thereof may serve as a shock absorbing portion 152. That is to say, thickness is made to vary and a thin portion becomes a hard portion 162 and a thick portion becomes the shock absorbing portion 152. A distance between a front surface of the shock absorbing portion 152 and a back surface 44*r* that is in contact with an outer peripheral side surface of a strong frame main body 15 is longer than that of the hard portion 162. When the string (31, 32) flexes back on this thick shock absorbing portion 152, due to a force exerted by the string (31, 32) at the time the ball is hit, the shock absorbing portion 152 more easily deforms inwardly of the loop portion 10 than the thin hard portion 162. Of course, as in a grommet member 143 shown in FIG. 15, the hard portions and the shock absorbing portions 153 having the same thickness can be provided in a mixed manner by double molding.

Figure 16A:
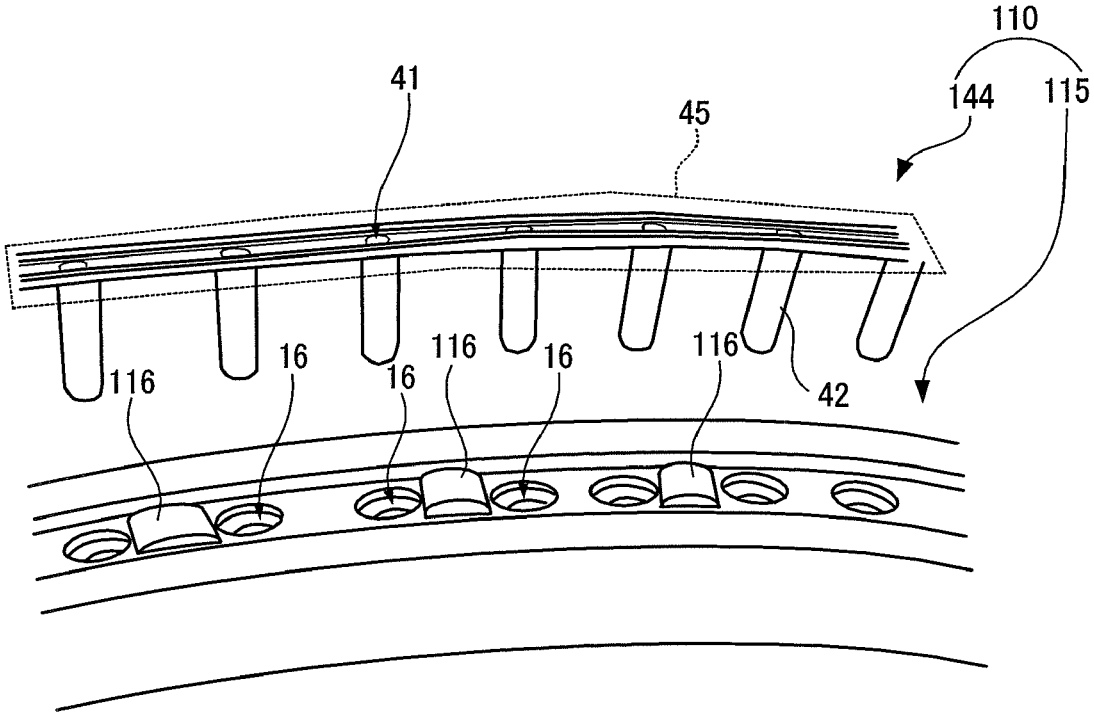
FIGS. 16A and 16B are diagrams showing a variant of the shock absorbing portion.
Figure 16B:
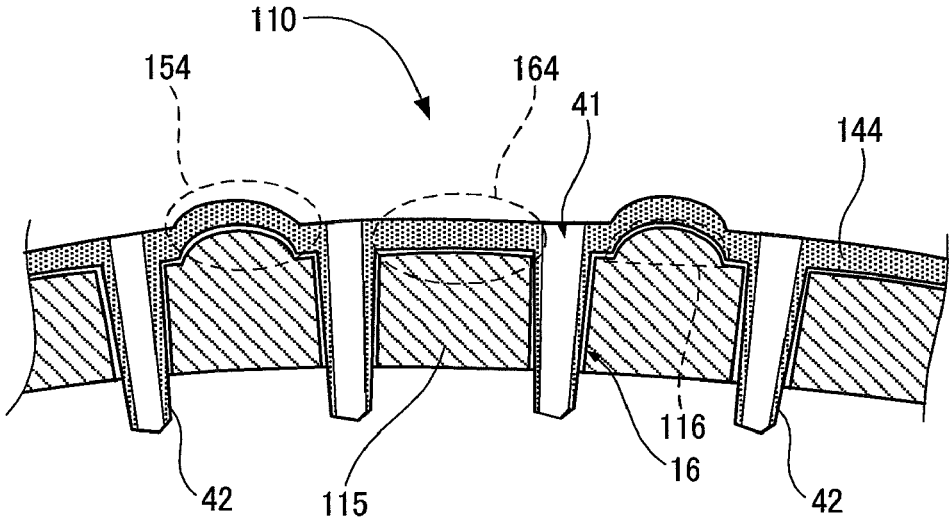

Further, the shock absorbing portion can be formed by devising the shape of the frame main body portion. FIGS. 16A and 16B show a structure in which the shock absorbing portion is faulted by the shape of the frame main body portion. FIG. 16A is an exploded enlarged view of a loop portion 110 and FIG. 16B is a sectional view of the loop portion 110 taken along a plane. The strip-like portion 45 of a grommet member 144 is made of the same material and has a uniform thickness, and a shock absorbing portion 154 is not formed by the grommet member 144 alone. On the other hand, on the outer peripheral side surface of the frame main body portion 115, protrusions 116 are alternately provided between guide holes 16 that are adjacent to each other. By attaching the grommet member 144 to the frame main body portion 115, protrusions and recesses are formed on a front face of the grommet member 144 and a protruded portion 154 serves as a shock absorbing portion 154. Of course, the loop portion need not be formed of the grommet member and the frame main body portion but may be provided as an integral structure in which the shock absorbing portions can be selectively formed by forming recesses and protrusions on the periphery of the loop portion 10 and by arranging the soft material and the hard material.

What is claimed is:

1. A tennis racket comprising:

a frame that includes a shaft and a looped frame portion, the shaft having a grip formed on one end side thereof, the frame portion being joined to the other end side of the shaft and forming a hitting face with a string being strung across; and a plurality of insertion holes that provide communication between an inner peripheral side surface and an outer peripheral side surface of the frame portion and through which the string is inserted, shock absorbing portions and hard portions being provided in an alternating fashion on at least a part of the outer peripheral side surface of the frame portion, each shock absorbing portion being formed between insertion holes that are adjacent to each other, each hard portion being formed between insertion holes that are adjacent to each other and being less elastically deformable than the shock absorbing portion, wherein the string is strung across by being guided from an inner side of the looped frame portion via the insertion hole to an outer side of the looped frame portion, flexed back and then guided to the inner side via another insertion hole, wherein a first coefficient of restitution is provided when the string is flexed back at the shock absorbing portion of the frame portion, and wherein a second coefficient of restitution is provided when the string is flexed back at the hard portion.

2. The tennis racket according to claim 1, wherein the shock absorbing portion is made of a material that is more elastically deformable than a material of the hard portion.

3. The tennis racket according to claim 1, wherein the shock absorbing portion is thicker than the hard portion.

4. The tennis racket according to claim 1, wherein, with a direction normal to the hitting face being a front-back direction and a direction extending from the frame portion to the grip being an up-down direction, the frame portion is provided with regions having no shock absorbing portion formed therein arranged at four positions on the outer peripheral side surface at upper left, upper right, lower left and lower right thereof.

5. The tennis racket according to claim 1, wherein, with a plane parallel to the hitting face being a flat plane, the shaft branches on the flat plane in a Y-shape from the grip side towards the frame portion and joins to the frame portion to form an opening portion that provides communication from a front side of the flat plane towards a depth direction, a hollow portion being formed in a side face of the shaft, the hollow portion providing communication in and out of the opening portion to arrange the insertion holes in a continuous manner along the loop shape of the frame portion.

6. The tennis racket according to claim 1, wherein the looped frame portion includes a frame main body portion forming a main body of the loop and a strip-like side surface member attached to an outer peripheral side surface of the frame main body portion, and wherein the shock absorbing portion and the hard portion are formed as portions of the strip-like side surface member with forming the strip-like side surface member by double molding.

7. The tennis racket according to claim 1, wherein the looped frame portion includes a frame main body portion forming a main body of the loop and a strip-like side surface member attached to an outer peripheral side surface of the frame main body portion, wherein the strip-like side surface member includes a strip-like portion that forms a recessed portion by bending, the strip-like portion being made of resin, and wherein another resin that is softer than the resin is filled in the recessed portion.

8. The tennis racket according to claim 7, wherein a portion corresponding to the recessed portion of the strip-like portion includes a column that is embedded in the other resin.

9. A tennis racket comprising:

a frame that includes a shaft and a looped frame portion, the shaft having a grip formed on one end side thereof, the frame portion being joined to the other end side of the shaft and forming a hitting face with a string being strung across; and a plurality of insertion holes that provide communication between an inner peripheral side surface and an outer peripheral side surface of the frame portion and through which the string is inserted, shock absorbing portions and hard portions being provided in an alternating fashion on at least a part of the outer peripheral side surface of the frame portion, each shock absorbing portion being formed between insertion holes that are adjacent to each other, each hard portion being formed between insertion holes that are adjacent to each other and being less elastically deformable than the shock absorbing portion, wherein the looped frame portion includes a frame main body portion forming a main body of the loop and a strip-like side surface member attached to an outer peripheral side surface of the frame main body portion, each of the insertion holes being a hollow portion of a hollow cylindrical tube portion, the side surface member having an opening of the insertion hole formed in a front surface thereof and is provided with the tube portion protruding from a back surface thereof, the frame main body portion being provided with guide holes and projections, each of the guide holes providing communication between the outer peripheral side surface and the inner peripheral side surface of the frame main body portion, the tube portion being inserted through the guide hole, the projections being alternately formed between the guide holes that are adjacent to each other, and the shock absorbing portion being formed by attaching the side surface member to the outer peripheral side surface of the frame main body portion and deforming the front surface of the side surface member by each of the projections into a protruded shape that protrudes outwardly of the frame portion.

10. A tennis racket comprising:

a frame that includes a shaft and a looped frame portion, the shaft having a grip formed on one end side thereof, the frame portion being joined to the other end side of the shaft and forming a hitting face with a string being strung across; and a plurality of insertion holes that provide communication between an inner peripheral side surface and an outer peripheral side surface of the frame portion and through which the string is inserted, shock absorbing portions and hard portions being provided in an alternating fashion on at least a part of the outer peripheral side surface of the frame portion, each shock absorbing portion being formed between insertion holes that are adjacent to each other, each hard portion being formed between insertion holes that are adjacent to each other and being less elastically deformable than the shock absorbing portion, wherein the string is strung across by being guided from an inner side of the looped frame portion via the insertion hole to an outer side of the looped frame portion, flexed back and then guided to the inner side via another insertion hole, and the frame member being provided with an indicating portion that specifies either or both a stringing start position for a case in which the string is flexed back at the shock absorbing portion of the frame portion and a stringing start position for a case in which the string is flexed back at the hard portion.

* * * * *